US009309472B2

(12) United States Patent
Vijay et al.

(10) Patent No.: US 9,309,472 B2
(45) Date of Patent: Apr. 12, 2016

(54) HYDROCRACKING OF GAS OILS WITH INCREASED DISTILLATE YIELD

(71) Applicants: Rohit Vijay, Bridgewater, NJ (US); Ajit Bhaskar Dandekar, Falls Church, VA (US); Michel Daage, Hellertown, PA (US); Christopher G. Oliveri, Humble, TX (US); Christine Nicole Elia, Bridgewater, NJ (US); Darryl Donald Lacy, Easton, PA (US); Scott J. Weigel, Allentown, PA (US); Bradley R. Fingland, Jackson, MI (US)

(72) Inventors: Rohit Vijay, Bridgewater, NJ (US); Ajit Bhaskar Dandekar, Falls Church, VA (US); Michel Daage, Hellertown, PA (US); Christopher G. Oliveri, Humble, TX (US); Christine Nicole Elia, Bridgewater, NJ (US); Darryl Donald Lacy, Easton, PA (US); Scott J. Weigel, Allentown, PA (US); Bradley R. Fingland, Jackson, MI (US)

(73) Assignee: EXXONMOBIL RESEARCH AND ENGINEERING COMPANY, Annandale, NJ (US)

( * ) Notice: Subject to any disclaimer, the term of this patent is extended or adjusted under 35 U.S.C. 154(b) by 29 days.

(21) Appl. No.: 14/541,393

(22) Filed: Nov. 14, 2014

(65) Prior Publication Data

US 2015/0152343 A1 Jun. 4, 2015

Related U.S. Application Data

(60) Provisional application No. 61/911,128, filed on Dec. 3, 2013.

(51) Int. Cl.
*C10G 65/00* (2006.01)
*C10G 67/14* (2006.01)
(Continued)

(52) U.S. Cl.
CPC ..... *C10G 67/14* (2013.01); *C10G 65/12* (2013.01); *C10G 67/02* (2013.01); *C10G 69/08* (2013.01); *C10G 2300/107* (2013.01);
(Continued)

(58) Field of Classification Search
CPC ..... C10G 67/14; C10G 65/12; C10G 69/08; C10G 67/02; C10G 2400/04; C10G 2300/301; C10G 2300/4025; C10G 2300/1074; C10G 2300/1077; C10G 2300/107; C10G 2400/10
See application file for complete search history.

(56) References Cited

U.S. PATENT DOCUMENTS 7,261,805 B2 8/2007 Grove et al.
8,303,804 B2 11/2012 Helton et al.
(Continued)

OTHER PUBLICATIONS

M.F.L. Johnson, "Estimation of the Zeolite Content of a Catalyst from Nitrogen Adsorption Isotherms", Journal of Catalysis, 1978, vol. 52, pp. 425-431.
(Continued)

*Primary Examiner* — Randy Boyer
*Assistant Examiner* — Juan Valencia
(74) *Attorney, Agent, or Firm* — Larry E. Carter; Chad A. Guice

(57) ABSTRACT

Methods are provided for improving the yield of distillate products from hydroprocessing of gas oil feedstocks, such as vacuum gas oils. It has been unexpectedly found that stripping of gases or fractionation to separate out a distillate fraction during initial hydrotreatment of a feed can provide a substantial increase in distillate yield at a desired amount of feedstock conversion. The improvement in yield of distillate products can allow a desired level of conversion to be performed on a feedstock for generating lubricating base oil products while reducing or minimizing the amount of naphtha (or lower) boiling range products. Alternatively, the improvement in yield of distillate products can correspond to an improved yield during a single pass through a reaction system, so that distillate yield is increased even though a lubricant boiling range product is not generated.

19 Claims, 3 Drawing Sheets

(51) Int. Cl.
*C10G 67/02* (2006.01)
*C10G 69/08* (2006.01)
*C10G 65/12* (2006.01)

(52) U.S. Cl.
CPC ..... *C10G 2300/1074* (2013.01); *C10G 2300/1077* (2013.01); *C10G 2300/301* (2013.01); *C10G 2300/4025* (2013.01); *C10G 2400/04* (2013.01); *C10G 2400/10* (2013.01)

(56) References Cited

U.S. PATENT DOCUMENTS

2011/0315596 A1 12/2011 Prentice et al.
2011/0315599 A1 12/2011 Prentice et al.
2012/0053377 A1* 3/2012 Mizan ..... C10G 3/45 585/240
2012/0080357 A1 4/2012 Novak et al.
2013/0264246 A1 10/2013 Holtzer et al.

OTHER PUBLICATIONS

PCT Application No. PCT/US2014/065620, Communication from the International Searching Authority, Forms PCT/ISA/220 and PCT/ISA/237, International Search Report and Written Opinion, 8 pages.

* cited by examiner

HYDROCRACKING OF GAS OILS WITH INCREASED DISTILLATE YIELD

CROSS-REFERENCE TO RELATED APPLICATIONS

This application claims priority to U.S. Provisional Application Ser. No. 61/911,128 filed Dec. 3, 2013, herein incorporated by reference in its entirety.

FIELD

This disclosure provides a system and a method for processing of sulfur- and/or nitrogen-containing feedstocks to produce distillate products.

BACKGROUND

Hydrocracking of hydrocarbon feedstocks is often used to convert lower value hydrocarbon fractions into higher value products, such as conversion of vacuum gas oil (VGO) feedstocks to various fuels and lubricants. Typical hydrocracking reaction schemes can include an initial hydrotreatment step, a hydrocracking step, and a post hydrotreatment step, such as dewaxing or hydrofinishing. After these steps, the effluent can be fractionated to separate out a desired diesel fuel and/or lubricant oil base oil.

A process train for hydrocracking a feedstock can be designed to emphasize the production of fuels or the production of lubricant base oils. During fuels hydrocracking, typically the goal of the hydrocracking is to cause conversion of higher boiling point molecules to molecules boiling in a desired range, such as the diesel boiling range, kerosene boiling range, and/or naphtha boiling range. Many types of fuels hydrocracking processes also generate a bottoms component from hydrocracking that potentially can be used as a lubricant base oil. However, the lubricant base oil is produced in a lesser amount, and often is recycled and/or hydrocracked again to increase the fuels yield. In hydrocracking for forming a lubricant base oil the goal of the hydrocracking is typically to remove contaminants and/or provide viscosity index uplift for the feed. This results in some feed conversion, however, so that a hydrocracking process for generating a lubricant base oil typically produces a lesser amount of fractions that boil in the diesel boiling range, kerosene boiling range, and/or naphtha boiling range. Due to the difference in the desired goals, the overall process conditions during fuels hydrocracking of a given feedstock typically differ from the overall process conditions during hydrocracking for lubricant base oil production on a similar type of feedstock.

U.S. Pat. No. 7,261,805 describes a method for dewaxing and cracking of hydrocarbon streams. A feedstock with an end boiling point exceeding 650° F. (343° C.) is contacted with a hydrocracking catalyst and an isomerization dewaxing catalyst to produce an upgraded product with a reduced wax content. The feedstock is described as contacting the hydrocracking catalyst first, but it is noted that the order of the steps can be changed without a significant decrease in yield.

U.S. Patent Application Publication 2012/0080357 describes a method for hydrocracking a feedstream to produce a converted fraction that includes a high distillate yield and improved properties and an unconverted fraction that includes a lubricant base oil fraction with improved properties. The hydrocracking can be a two-stage hydrocracking system that includes a USY catalyst and a ZSM-48 catalyst.

U.S. Pat. No. 8,303,804 describes a method for producing a jet fuel, such as by hydrotreatment and dewaxing of a kerosene feedstock. The dewaxing can be performed using a ZSM-48 catalyst.

SUMMARY

In an aspect, a method for processing a feedstock to form a distillate product is provided. The method includes contacting a feedstock having a T5 boiling point of at least about 473° F. (245° C.) with a first hydrotreating catalyst under first effective hydrotreating conditions to produce a first hydrotreated effluent, the first hydrotreating catalyst comprising at least one Group Viii non-noble metal and at least one Group VIB metal on a refractory support; performing a separation on the first hydrotreated effluent to form at least a first separated effluent portion and a first remaining effluent portion; contacting the first remaining effluent portion with a second hydrotreating catalyst under second effective hydrotreating conditions to produce a second hydrotreated effluent, the second hydrotreating catalyst comprising at least one Group VIII non-noble metal and at least one Group VIB metal on a refractory support; fractionating the second hydrotreated effluent to form at least a hydrotreated distillate boiling range product and a second remaining effluent portion, the second remaining effluent portion having a T5 boiling point of at least about 700° F.; contacting the second remaining effluent portion with a hydrocracking catalyst under effective hydrocracking conditions to produce a hydrocracked effluent, the hydrocracking catalyst comprising a large pore molecular sieve; and fractionating the hydrocracked effluent to produce at least a hydrocracked distillate boiling range product.

DETAILED DESCRIPTION

Figure 1:
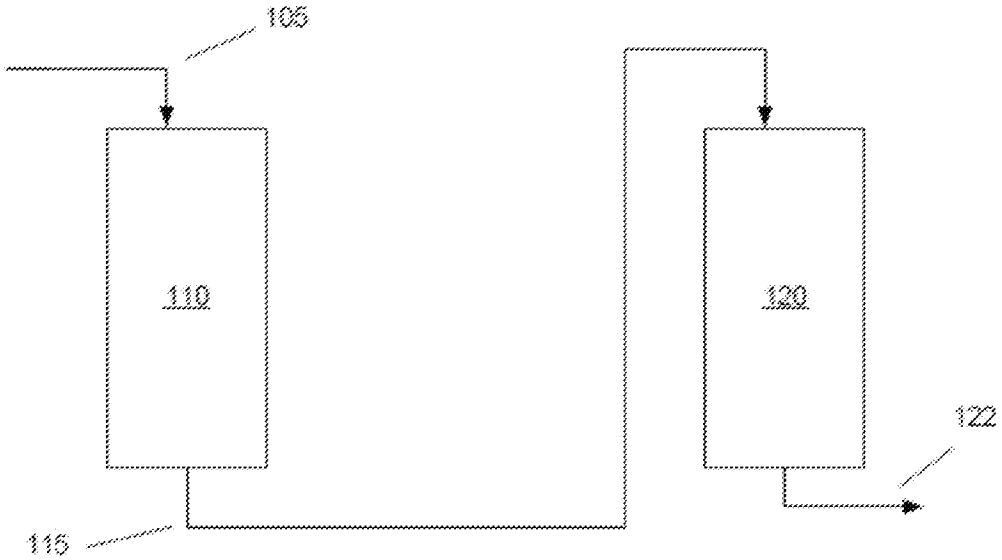
FIG. 1 schematically shows an example of a multi-stage reaction system.

All numerical values within the detailed description and the claims herein are modified by "about" or "approximately" the indicated value, and take into account experimental error and variations that would be expected by a person having ordinary skill in the art.

Overview

In various embodiments, systems and methods are provided for improving the yield of distillate products from hydroprocessing (including hydrotreatment, hydrocracking, and/or catalytic dewaxing) of gas oil feedstocks, such as vacuum gas oil feeds or other feeds having a similar type of boiling range. It has been unexpectedly found that stripping of gases or fractionation to separate out a distillate fraction during initial hydrotreatment of a feed can provide a substantial increase in distillate yield at a desired amount of feedstock conversion. In some aspects, the improvement in yield of distillate products allows a desired level of conversion to be performed on a feedstock for generating lubricating base oil products while reducing or minimizing the amount of naphtha (or lower) boiling range products. In other aspects, the improvement in yield of distillate products corresponds to an improved yield during a single pass through a reaction system, so that distillate yield is increased even though a lubricant boiling range product is not generated.

As an example, some improvements in distillate product yield can be achieved based on separation or removal of contaminant gases during hydrotreatment of a feedstock. This can reduce the required severity of subsequent processing stages, allowing for less conversion of desired distillate boiling range products to naphtha or lower boiling range products. Removal of contaminant gases can also reduce the temperature required to achieve a desired level of conversion to distillates, or alternatively, increase the amount of conversion at a specified temperature. Other improvements in distillate yield can be achieved by fractionating the feedstock during hydrotreatment, so that distillate boiling range components are exposed to fewer hydroprocessing stages. Avoiding exposure of distillate boiling range products to additional hydroprocessing, such as a second hydrotreatment stage, can prevent further conversion of such products to naphtha or lower boiling range products. Still other improvements in distillate yield can be achieved by stripping contaminant gases and/or fractionating the hydrotreated feedstock after hydrotreatment and before hydrocracking. Once again, this can reduce additional conversion of products by avoiding exposure to a downstream hydrocracking stage or reducing the severity of such a stage. Yet other improvements in distillate yield can be achieved by dewaxing a hydrotreated feed prior to hydrocracking. During hydrocracking, paraffinic molecules with few or no branches can require higher severity conditions in order to achieve desired levels of conversion. Such higher severity conditions can result in overcracking of other types of species, such as naphthenic or aromatic molecules, which can reduce overall yield in the distillate boiling range. Performing dewaxing prior to hydrocracking can increase the number of branches in paraffinic molecules, which reduce the severity required to achieve the desired level of conversion for such paraffinic molecules. In still other aspects, two or more of these distillate yield improvement techniques can be combined to provide still higher yield of distillate products.

A desired distillate product can be generated by hydroprocessing a feedstock having a suitable boiling range. The feedstock can optionally be suitable for generation of a lubricant base oil (which could also be referred to as a lubricant base stock). The process can typically include at least two of hydrotreating, hydrocracking, and catalytic dewaxing of the feedstock. Optionally the process can further include hydrofinishing of the feedstock. The process can result in production of a converted fraction that includes a distillate boiling range product and an unconverted portion. Optionally, the unconverted portion can be recycled for further production of distillate boiling range products. Additionally or alternately, the unconverted portion can include a lubricant boiling range product, or the unconverted portion can be used as a feed for another process such as fluid catalytic cracking.

In various aspects, methods are provided for enhancing distillate production at a given total level of feed conversion. In some aspects, the total amount of feed conversion can indicate the suitability of the unconverted portion of the feed for use as a product, such as a lubricant base oil product. By improving distillate yield at a given level of conversion, a desired lubricant boiling range product can be produced, including a desired amount of lubricant boiling range product, while also generating an increased amount of distillate boiling range product. Thus, the increase in the amount of distillate product can be at the expense of additional naphtha or lower boiling range products. This is in contrast to conventional methods, which can lead to reduced yields of lubricant boiling range products when improving distillate yield. Alternatively, improving distillate yield at a given level of conversion can also be beneficial for feeds where the unconverted portion will be used as a feed for another refinery process, such as fluid catalytic cracking or coking. In still other aspects, improving the distillate yield at a given level of conversion can allow for improved throughput in a reaction system. For example, in a fuels hydrocracking system with recycle to maximize production of products in the fuels boiling range, increasing the distillate yield at a given level of conversion can reduce the amount of recycle of unconverted bottoms that is required for the reaction system, which allows for increased processing of fresh feedstock.

In this discussion, the distillate boiling range is defined as 350° F. (177° C.) to 700° F. (371° C.). Distillate boiling range products can include products suitable for use as kerosene products (including jet fuel products) and diesel products, such as premium diesel or winter diesel products. Such distillate boiling range products can be suitable for use directly, or optionally after further processing.

In various aspects, an additional advantage of performing an intermediate fractionation to recover a distillate boiling range product is an expansion of the types of suitable feedstocks. For conventional systems where hydrotreatment and hydrocracking are performed on a feed without intermediate recovery of products, any distillate boiling range components present in the feed are exposed to the full range of hydroprocessing. This can lead to substantial reaction of such distillate boiling range components present in the initial feed, leading to formation of naphtha and light ends type products at the expense of the original distillate components in the feed. By performing an intermediate fractionation, distillate boiling range components can be exposed to at least a portion of a hydrotreatment stage and then separated out. This allows for sulfur reduction in the resulting distillate product while reducing or minimizing the amount of loss of distillate boiling range components present in the initial feed. Instead, an increased amount of such original distillate boiling range components can be included in the eventual distillate product.

In this discussion, the severity of hydroprocessing performed on a feed can be characterized based on an amount of conversion of the feedstock. In various aspects, the reaction conditions in the reaction system can be selected to generate a desired level of conversion of a feed. Conversion of a feed is defined in terms of conversion of molecules that boil above a temperature threshold to molecules below that threshold. The conversion temperature can be any convenient temperature. Unless otherwise specified, the conversion temperature in this discussion is a conversion temperature of 700° F. (371° C.).

The amount of conversion can correspond to the total conversion of molecules within any stage of the reaction system that is used to hydroprocess the lower boiling portion of the feed from the vacuum distillation unit. The amount of conversion desired for a suitable feedstock can depend on a variety of factors, such as the boiling range of the feedstock, the amount of heteroatom contaminants (such as sulfur and/or nitrogen) in the feedstock, and/or the nature of the desired lubricant products. Suitable amounts of conversion across all hydroprocessing stages can correspond to at least about 25 wt % conversion of 700° F.+(371° C.+) portions of the feedstock to portions boiling below 700° F., such as at least about 35 wt %, or at least about 45 wt %, or at least about 50 wt %. In various aspects, the amount of conversion is about 75 wt % or less, such as about 65 wt % or less, or 55 wt % or less. It is noted that the amount of conversion refers to conversion during a single pass through a reaction system. For example, a portion of the unconverted feed (boiling at above 700° F.)

can be recycled to the beginning of the reaction system and/or to another earlier point in the reaction system for further hydroprocessing.

In this discussion, a stage can correspond to a single reactor or a plurality of reactors. Optionally, multiple parallel reactors can be used to perform one or more of the processes, or multiple parallel reactors can be used for all processes in a stage. Each stage and/or reactor can include one or more catalyst beds containing hydroprocessing catalyst. Note that a "bed" of catalyst in the discussion below can refer to a partial physical catalyst bed. For example, a catalyst bed within a reactor could be filled partially with a hydrocracking catalyst and partially with a dewaxing catalyst. For convenience in description, even though the two catalysts may be stacked together in a single catalyst bed, the hydrocracking catalyst and dewaxing catalyst can each be referred to conceptually as separate catalyst beds.

In this discussion, a medium pore dewaxing catalyst refers to a catalyst that includes a 10-member ring molecular sieve. Examples of molecular sieves suitable for forming a medium pore dewaxing catalyst include 10-member ring 1-dimensional molecular sieves, such as EU-1, ZSM-35 (or ferrierite), ZSM-11, ZSM-57, SAPO-11, ZSM-48, ZSM-23, and ZSM-22. In this discussion, a large pore hydrocracking catalyst refers to a catalyst that includes a 12-member ring molecular sieve. An example of a molecular sieve suitable for forming a large pore hydrocracking catalyst is USY zeolite with a silica to alumina ratio of about 200:1 or less and a unit cell size of about 24.5 Angstroms or less.

Feedstocks

A wide range of petroleum and chemical feedstocks can be hydroprocessed in accordance with the present invention. Some suitable feedstocks include gas oils, such as vacuum gas oils. More generally, suitable feedstocks include whole and reduced petroleum crudes, atmospheric and vacuum residua, solvent deasphalted residua, cycle oils, FCC tower bottoms, gas oils, including atmospheric and vacuum gas oils and coker gas oils, light to heavy distillates including raw virgin distillates, hydrocrackates, hydrotreated oils, dewaxed oils, slack waxes, Fischer-Tropsch waxes, raffinates, and mixtures of these materials.

One way of defining a feedstock is based on the boiling range of the feed. One option for defining a boiling range is to use an initial boiling point for a feed and/or a final boiling point for a feed. Another option, which in some instances may provide a more representative description of a feed, is to characterize a feed based on the amount of the feed that boils at one or more temperatures. For example, a "T5" boiling point for a feed is defined as the temperature at which 5 wt % of the feed will boil off. Similarly, a "T95" boiling point is a temperature at which 95 wt % of the feed will boil, while a "T99.5" boiling point is a temperature at which 99.5 wt % of the teed will boil.

Typical feeds include, for example, feeds with an initial boiling point of at least about 650° F. (343° C.), or at least about 700° F. (371° C.), or at least about 750° F. (399° C.). The amount of lower boiling point material in the feed may impact the total amount of diesel generated as a side product. Alternatively, a feed may be characterized using a T5 boiling point, such as a feed with a T5 boiling point of at least about 650° F. (343° C.), or at least about 700° F. (371° C.), or at least about 750° F. (399° C.). Typical feeds include, for example, feeds with a final boiling point of about 1150° F. (621° C.), or about 1100° F. (593° C.) or less, or about 1050° F. (566° C.) or less. Alternatively, a feed may be characterized using a T95 boiling point, such as a feed with a T95 boiling point of about 1150° F. (621° C.), or about 1100° F. (593° C.) or less, or about 1050° F. (566° C.) or less. It is noted that feeds with still lower initial boiling points and/or T5 boiling points may also be suitable for increasing the yield of premium diesel, so long as sufficient higher boiling material is available so that the overall nature of the process is a lubricant base oil production process. Feedstocks such as deasphalted oil with a final boiling point or a T95 boiling point of about 1150° F. (621° C.) or less may also be suitable.

In some aspects, feeds with an increased amount of distillate boiling range components can be used as feedstocks. Traditionally such distillate boiling range components would be excluded from a process for hydrocracking of a gas oil feed, in order to avoid conversion of the distillate components to less valuable naphtha or light ends products. In such aspects, the T5 boiling point of a feedstock can be at least about 473° F. (245° C.), such as at least about 527° F. (275° C.), or at least about 572° F. (300° C.), or at least about 600° F. (316° C.).

In embodiments involving an initial sulfur removal stage prior to hydrocracking, the sulfur content of the feed can be at least 100 ppm by weight of sulfur, or at least 1000 wppm, or at least 2000 wppm, or at least 4000 wppm, or at least 20,000 wppm, or at least about 40,000 wppm. In other embodiments, including some embodiments where a previously hydrotreated and/or hydrocracked feed is used, the sulfur content can be about 2000 wppm or less, or about 1000 wppm or less, or about 500 wppm or less, or about 100 wppm or less.

In some embodiments, at least a portion of the feed can correspond to a feed derived from a biocomponent source. In this discussion, a biocomponent feedstock refers to a hydrocarbon feedstock derived from a biological raw material component, from biocomponent sources such as vegetable, animal, fish, and/or algae. Note that, for the purposes of this document, vegetable fats/oils refer generally to any plant based material, and can include fat/oils derived from a source such as plants of the genus *Jatropha*. Generally, the biocomponent sources can include vegetable fats/oils, animal fats/oils, fish oils, pyrolysis oils, and algae lipids/oils, as well as components of such materials, and in some embodiments can specifically include one or more type of lipid compounds. Lipid compounds are typically biological compounds that are insoluble in water, but soluble in nonpolar (or fat) solvents. Non-limiting examples of such solvents include alcohols, ethers, chloroform, alkyl acetates, benzene, and combinations thereof.

Hydroprocessing with Improved Distillate Product Yield with Interstage Fractionation Various types of hydroprocessing can be used in the production of distillate products. Typical processes include hydrotreating and/or hydrocracking processes to remove contaminants and/or provide uplift in the viscosity index (VI) of the feed. The hydrotreated and/or hydrocracked feed can then optionally be dewaxed to improve cold flow properties, such as pour point or cloud point. The hydrocracked, optionally dewaxed feed can then optionally be hydrofinished, for example, to remove aromatics from the lubricant base oil product. This can be valuable for removing compounds that are considered hazardous under various regulations.

In some aspects, improvements in distillate yield can be achieved for configurations involving hydrotreatment of a feed Mowed by hydrocracking of the feed. Dewaxing can optionally be performed prior to and/or after hydrocracking if a lubricant base oil product is desired and/or to improve the cold flow properties of the distil late product.

In this discussion, a hydrotreatment process refers to a process involving a catalyst with at least one Group VI or Group VIII metal supported on a refractory support, such as an amorphous oxide support. Preferably, a hydrotreating catalyst can include a support that is substantially free from molecular sieves, such as a support that contains about 0.01 wt % or less of molecular sieves. Conversion on hydrotreating catalysts can typically occur via reaction mechanisms associated with hydrodesulfurization (HDS), hydrodenitrogenation (HDN), aromatic ring saturation, and/or dealkylation. By contrast, a hydrocracking process refers to a process involving a catalyst that includes a molecular sieve, such as a catalyst that incorporates a zeolite or another type of crystalline molecular sieve. Conversion over hydrocracking catalysts can typically occur via reaction mechanisms associated with aromatic ring saturation, ring opening, dealkylation, paraffin isomerization, and/or cracking.

Figure 2:
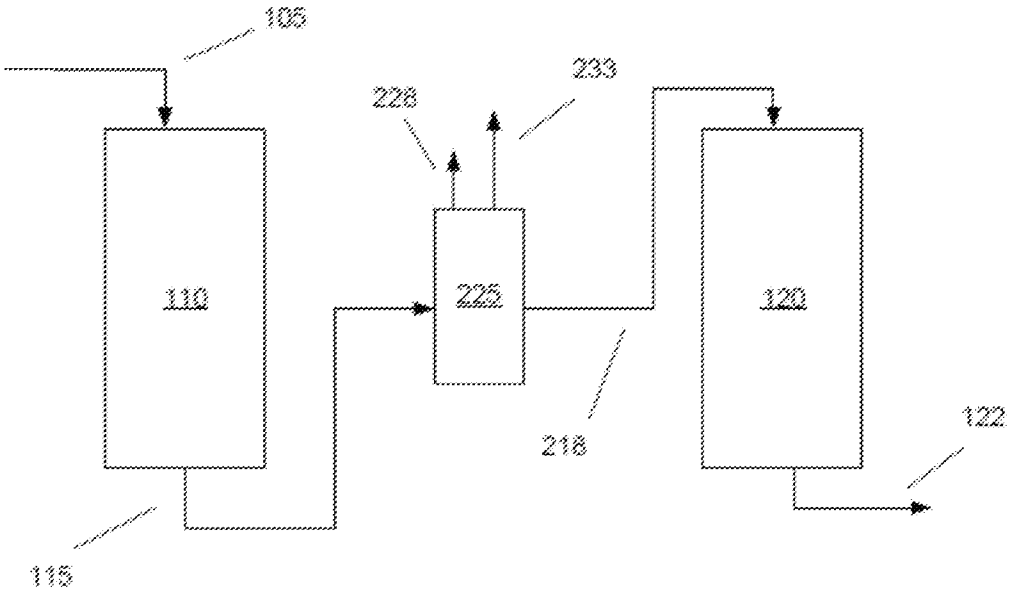
FIG. 2 schematically shows an example of a multi-stage reaction system according to an embodiment of the invention.
Figure 3:
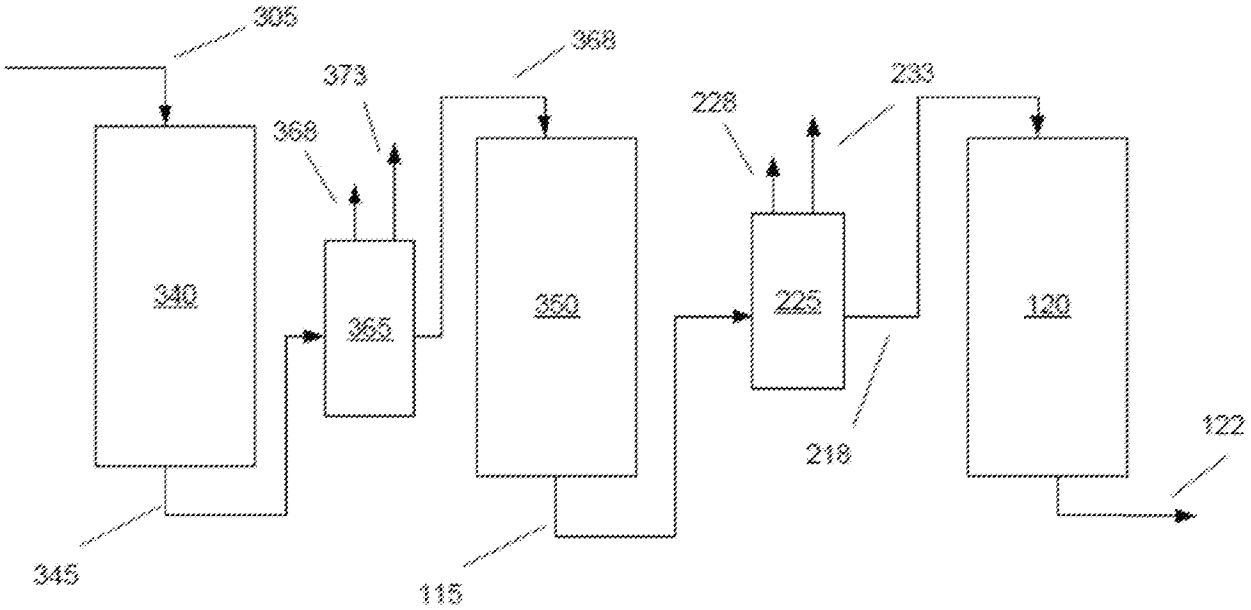
FIG. 3 schematically shows an example of a multi-stage reaction system according to an embodiment of the invention.

FIGS. 1-3 show examples of possible configurations for performing hydrotreating and hydrocracking on a suitable feedstock, such as a vacuum gas oil feedstock. In the configuration shown in FIG. 1, a feed 105 is hydrotreated 110 for removal of sulfur and/or nitrogen and then hydrocracked 120. The effluent 115 from hydrotreatment stage 110 is cascaded into hydrocracking stage 120 without stripping or other intermediate separation. The hydrocracking stage generates a hydrocracked effluent 122 that can include a hydrocracked distillate boiling range product.

A configuration such as FIG. 1 provides a baseline level of distillate yield for processing a feedstock. In FIG. 1, the hydrotreatment stage can be used for desulfurization and/or denitrogenation of a feed to a desired level at a lower level of severity as compared to using a hydrocracking stage for heteroatom removal. The hydrocracking stage can then be used perform additional conversion on the hydrotreated feed until a desired level of conversion is reached. However, since the effluent from the hydrotreating stage is cascaded into the hydrocracking stage, the $H_2S$ and $NH_3$ generated during hydrotreatment are also passed into the hydrocracking stage. This can suppress the activity of the hydrocracking catalyst, leading to higher severity conditions to achieve a desired level of conversion.

FIG. 2 shows a variation on FIG. 1 where the effluent 115 can pass through a separation stage 225 after hydrotreatment stage 110 and prior to hydrocracking stage 120. One option is to use a gas-liquid separator or stripper as separation stage 225. In this option, contaminant gases 228 formed during hydrotreatment, such as and $NH_3$, as well as other light ends, can be removed from the effluent prior to hydrocracking. However, any distillate in the effluent 115 is still passed into hydrocracking stage 120. Alternatively, separation stage 225 can correspond to a fractionator, such as a distillation column or a flash separator, that allows for removal of at least contaminant gases 228 and a distillate boiling range portion 233 of effluent 115 prior the effluent entering the hydrocracking stage 120. In this alternative, the remaining portion 218 of the effluent can correspond to an unconverted portion of the initial feed 105 that boils above the distillate boiling range. If a flash separator is used, the distillate boiling range portion 233 may also initially include a naphtha boiling range portion as well light ends. The distillate boiling range portion could then be separated from other portions at a later time. If a fractionator is used, a separate naphtha boiling range portion (not shown) can also be formed during separation of the distillate boiling range portion.

The types of configurations exemplified by FIG. 2 can provide at least two types of benefits relative to a configuration similar to FIG. 1. For configurations where contaminant gases are removed prior to passing the hydrotreated effluent into the hydrocracking stage, the removal of contaminant gases allows fir use of milder reaction conditions in the hydrocracking stage while achieving a similar level of feed conversion. This can be due, for example, to the catalysts in the hydrocracking stage having a higher effective catalytic activity when catalyst suppressants or poisons (such as contaminant gases) are removed. Another potential benefit can be achieved in configurations where a distillate product portion is removed from the effluent prior to passing the effluent into the hydrocracking stage, in such a configuration, the distillate product portion removed prior to hydrocracking is not exposed to further hydroprocessing conditions, and therefore such a removed product portion is not further cracked to compounds boiling below the distillate boiling range. Example 1 below demonstrates the benefit of a configuration according to FIG. 2 versus the configuration in FIG. 1.

FIG. 3 shows a potential variation in how the feed is hydrotreated. In FIG. 3, instead of hydrotreating a feed using a single hydrotreating stage, a feed 305 is hydrotreated in at least two hydrotreatment stages 340 and 350. A separation stage 365 between the hydrotreatment stages 340 and 350 can either correspond to a gas-liquid separation stage (such as a stripper) or a fractionation stage. If separation stage 365 is a gas-liquid separation stage, contaminant gases and other light ends 368 can be removed from effluent 345. If separation stage 365 is a fractionator, a distillate boiling range portion 373 can be separated out from the remaining portion 368 of the effluent prior to hydrocracking.

The types of configurations exemplified by FIG. 3 can provide at least two types of benefits relative to a configuration similar to FIG. 1 or FIG. 2. For configurations where contaminant gases are removed at an intermediate location during hydrotreating, the removal of contaminant gases allows for use of milder reaction conditions in the later catalyst beds of the hydrotreating stage while achieving a similar level of feed desulfurization. This can be due, for example, to the catalysts in the later hydrotreatment beds having a higher effective catalytic activity when catalyst suppressants or poisons (such as contaminant gases) are removed. Another potential benefit can be achieved in configurations where a distillate product portion is removed at an intermediate location during hydrotreating. In such a configuration, the distillate product portion removed at the intermediate location is not exposed to further hydroprocessing conditions in the later hydrotreatment catalyst beds, and therefore such a removed product portion is not further converted to compounds boiling below the distillate boiling range. Example 2 below shows the benefits of a configuration according to FIG. 3 relative to FIGS. 1 and 2.

When the separation is performed between two stages (such as between two hydrotreating stages or between a hydrotreating stage and a hydrocracking stage), the separation can result in formation of at least a separated effluent portion (that is removed from further processing) and a remaining effluent portion that is passed into the next hydroprocessing stage. When the separation corresponds to stripping of gases or another gas-liquid type separation, the separated effluent portion can have a relatively low final boiling point. For example, the T95 boiling points of the separated effluent can be about 250° F. (121° C.) or less, such as about 200° F. (93° C.) or less, or about 150° F. (65° C.) or less or about 100° F. (38° C.) or less. It is noted that the above T95 boiling points contemplate separations where the separated effluent contains naphtha boiling range components, but does not contain distillate boiling range components.

When the separation corresponds to a fractionation, the separated effluent portion can include a distillate boiling range product, either as part of a single separated effluent, or as one of several separated products generated by the fractionation that are not exposed to further hydroprocessing. In such aspects, the remaining effluent portion can correspond to a bottoms portion from the fractionation. Depending on the nature of the separation, the remaining effluent portion can have a T5 boiling point of at least about 600° F. (316° C.), such as at least about 650° F. (343° C.), or at least about 700° F. (371° C.). For the lower T5 boiling points, the remaining portion of the effluent may contain substantial amounts of distillate boiling range components that are exposed to further hydroprocessing. This strategy might be used, for example, to provide for further removal of sulfur or nitrogen from the heavier portions of the distillate boiling range components. If it is desired to substantially remove all distillate boiling range components from the remaining portion of the effluent, the fractionation can be performed to generate a remaining effluent portion with a T5 boiling point of at least about 700° F. (371° C.). For example, a fractionation to substantially remove all distillate boiling range components can be performed on the effluent from a hydrotreating stage prior to passing the effluent into a dewaxing stage or a hydrocracking stage.

Hydrocracking with Improved Conversion or Improved Distillate Yield

In some aspects, additional distillate yield can also be achieved by exposing a hydrotreated feedstock to hydrocracking and dewaxing catalysts in a specific order. In particular, for a medium pore size dewaxing catalyst that performs dewaxing primarily by isomerization, exposing the hydrotreated feedstock to the dewaxing catalyst prior to exposing the feedstock to a large pore hydrocracking catalyst can reduce the required severity in the hydrocracking stage for achieving a desired level of feed conversion.

Alternatively, using a medium pore size dewaxing catalyst prior to a large pore hydrocracking catalyst can achieve a similar distillate yield relative to a conventional configuration but lead to improved conversion without increasing the severity of the hydrocracking conditions. For lubricant base oil production, achieving a desired lubricant base oil product often involves hydroprocessing of a feedstock to achieve a desired level of feed conversion. The remaining unconverted portion of the feed is then suitable for use (after optional further processing) as a lubricant base stock. Achieving a desired level of conversion for lubricant base stock production at lower severity processing conditions can be beneficial for various reasons, such as improved catalyst lifetime and/or process run length, or reduced hydrogen consumption during processing.

Some types of large pore hydrocracking catalysts, such as hydrocracking catalysts containing zeolite Y, can be selective for cracking of cyclic and/or branched compounds relative to paraffinic compounds. As a result, when a feedstock with a sufficient amount of waxy components is hydrocracked, the waxy compounds require higher severity conditions for cracking. This can lead to overall higher severity conditions for cracking of a feed in order to achieve a desired level of feed conversion.

Conventionally, dewaxing is typically performed after hydrocracking. While this can be effective for generating a feed having desired cold flow properties, such a configuration does not necessarily improve distillate yield. In contrast to a conventional configuration, a dewaxing catalyst having isomerization dewaxing activity can be used for catalytic dewaxing of a feedstock prior to hydrocracking. In this type of configuration, dewaxing of the feedstock can allow waxy or paraffinic molecules in the feedstock to be converted to compounds with a larger number of branches. Such branched compounds can be more easily cracked when exposed to a hydrocracking catalyst. This can allow for use of lower severity conditions in order to achieve a desired level of feed conversion. Under such lower severity conditions, the amount of "overcracking" to convert distillate compounds to lower boiling compounds (such as naphtha or light ends) can be reduced, resulting in a greater yield of distillate boiling range product at a given level of feed conversion. Alternatively, performing dewaxing prior to hydrocracking can allow for increased feed conversion at reaction conditions with similar severity. Example 3 demonstrates the benefit of this improved configuration for dewaxing and hydrocracking catalyst beds or stages.

Hydrotreatment Conditions

Hydrotreatment is typically used to reduce the sulfur, nitrogen, and aromatic content of a feed. The catalysts used for hydrotreatment can include conventional hydroprocessing catalysts, such as those that comprise at least one Group VIII non-noble metal (Columns 8-10 of IUPAC periodic table), preferably Fe, Co, and/or Ni, such as Co and/or Ni; and at least one Group VI metal (Column 6 of IUPAC periodic table), preferably Mo and/or W. Such hydroprocessing catalysts can optionally include transition metal sulfides. These metals or mixtures of metals are typically present as oxides or sulfides on refractory metal oxide supports. Suitable metal oxide supports include low acidic oxides such as silica, alumina, titania, silica-titania, and titania-alumina. Suitable aluminas are porous aluminas such as gamma or eta having average pore sizes from 50 to 200 Å, or 75 to 150 Å; a surface area from 100 to 300 $m^2/g$, or 150 to 250 $m^2/g$; and a pore volume of from 0.25 to 1.0 $cm^3/g$, or 0.35 to 0.8 $cm^3/g$. The supports are preferably not promoted with a halogen such as fluorine as this generally increases the acidity of the support.

The at least one Group Vin non-noble metal, in oxide form, can typically be present in an amount ranging from about 2 wt % to about 40 wt %, preferably from about 4 wt % to about 15 wt %. The at least one Group VI metal, in oxide form, can typically be present in an amount ranging from about 2 wt % to about 70 wt %, preferably for supported catalysts from about 6 wt % to about 40 wt % or from about 10 wt % to about 30 wt %. These weight percents are based on the total weight of the catalyst. Suitable metal catalysts include cobalt/molybdenum (1-10% Co as oxide, 10-40% Mo as oxide), nickell-molybdenum (1-10% Ni as oxide, 10-40% Co as oxide), or nickel/tungsten (1-10% Ni as oxide, 10-40% W as oxide) on alumina, silica, silica-alumina, or titania.

Alternatively, the hydrotreating catalyst can be a bulk metal catalyst, or a combination of stacked beds of supported and bulk metal catalyst. By bulk metal, it is meant that the catalysts are unsupported wherein the bulk catalyst particles comprise 30-100 wt. % of at least one Group VIII non-noble metal and at least one Group VIB metal, based on the total weight of the bulk catalyst particles, calculated as metal oxides and wherein the bulk catalyst particles have a surface area of at least 10 $m^2/g$. It is furthermore preferred that the bulk metal hydrotreating catalysts used herein comprise about 50 to about 100 wt %, and even more preferably about 70 to about 100 wt %, of at least one Group VIII non-noble metal and at least one Group VIB metal, based on the total weight of the particles, calculated as metal oxides. The amount of Group VIB and Group VIII non-noble metals can easily be determined VIB FEM-EDX.

Bulk catalyst compositions comprising one Group VIII non-noble metal and two Group VIB metals are preferred. It has been found that in this case, the bulk catalyst particles are sintering-resistant. Thus the active surface area of the bulk catalyst particles is maintained during use. The molar ratio of Group VIB to Group VIII non-noble metals ranges generally from 10:1-1:10 and preferably from 3:1-1:3. In the case of a core-shell structured particle, these ratios of course apply to the metals contained in the shell. If more than one Group VIB metal is contained in the bulk catalyst particles, the ratio of the different Group VIB metals is generally not critical. The same holds when more than one Group VIII non-noble metal is applied. In the case where molybdenum and tungsten are present as Group VIB metals, the molybdenum:tungsten ratio preferably lies in the range of 9:1-1:9. Preferably the Group Viii non-noble metal comprises nickel and/or cobalt. It is further preferred that the Group VIB metal comprises a combination of mollybdenum and tungsten. Preferably, combinations of nickel/molybdenum/tungsten and cobalt/molybdenum/tungsten and nickel/cobalt/molybdenum/tungsten are used. These types of precipitates appear to be sinter-resistant. Thus, the active surface area of the precipitate is maintained during use. The metals are preferably present as oxidic compounds of the corresponding metals, or if the catalyst composition has been sulfided, sulfidic compounds of the corresponding metals.

It is also preferred that the bulk metal hydrotreating catalysts used herein have a surface area of at least 50 $m^2/g$ and more preferably of at least 100 $m^2/g$. It is also desired that the pore size distribution of the bulk metal hydrotreating catalysts be approximately the same as the one of conventional hydrotreating catalysts. Bulk metal hydrotreating catalysts have a pore volume of 0.05-5 ml/g, or of 0.1-4 ml/g, or of 0.1-3 ml/g, or of 0.1-2 ml/g determined by nitrogen adsorption. Preferably, pores smaller than 1 nm are not present. The bulk metal hydrotreating catalysts can have a median diameter of at least 50 nm, or at least 100 nm. The hulk metal hydrotreating catalysts can have a median diameter of not more than 5000 μm, or not more than 3000 μm. In an embodiment, the median particle diameter lies in the range of 0.1-50 μm and most preferably in the range of 0.5-50 μm.

The hydrotreatment is carried out in the presence of hydrogen. A hydrogen stream is, therefore, fed or injected into a vessel or reaction zone or hydroprocessing zone in which the hydroprocessing catalyst is located. Hydrogen, which is contained in a hydrogen-containing "treat gas," is provided to the reaction zone. Treat gas, as referred to in this invention, can be either pure hydrogen or a hydrogen-containing gas, which is a gas stream containing hydrogen in an amount that is sufficient for the intended reaction(s), optionally including one or more other gasses (e.g., nitrogen and light hydrocarbons such as methane), and which will not adversely interfere with or affect either the reactions or the products. Impurities, such as $H_2S$ and $NH_1$ are undesirable and would typically be removed from the treat gas before it is conducted to the reactor. The treat gas stream introduced into a reaction stage will preferably contain at least about 50 vol. % and more preferably at least about 75 vol. % hydrogen.

Hydrotreating conditions can include temperatures of about 200° C. to about 450° C., or about 315° C. to about 425° C.; pressures of about 250 psig (1.8 MPag) to about 5000 psig (34.6 MPag) or about 300 psig (2.1 MPag) to about 3000 psig (20.8 MPag); liquid hourly space velocities (LHSV) of about 0.1 $hr^{-1}$ to about 10 $hr^{-}$; and hydrogen treat rates of about 200 scf/B (35.6 $m^3/m^3$) to about 10,000 scf/B (1781 $m^3/m^3$), or about 500 (89 $m^3/n$) to about 10,000 scf/B (1781 $m^3/m^3$).

Hydrocracking Conditions

Hydrocracking catalysts typically contain sulfided base metals on acidic supports, such as amorphous silica alumina, cracking zeolites or other cracking molecular sieves such as USY, or acidified alumina. In some preferred aspects, a hydrocracking catalyst can include at least one molecular sieve, such as a zeolite. Often these acidic supports are mixed or bound with other metal oxides such as alumina, titania or silica. Non-limiting examples of supported catalytic metals for hydrocracking catalysts include nickel, nickel-cobalt-molybdenum, cobalt-molybdenum, nickel-tungsten, nickel-molybdenum, and/or nickel-molybdenum-tungsten. Additionally or alternately, hydrocracking catalysts with noble metals can also be used. Non-limiting examples of noble metal catalysts include those based on platinum and/or palladium. Support materials which may be used for both the noble and non-noble metal catalysts can comprise a refractory oxide material such as alumina, silica, alumina-silica, kieselguhr, diatomaceous earth, magnesia, zirconia, or combinations thereof, with alumina, silica, alumina-silica being the most common (and preferred, in one embodiment).

In some aspects, a hydrocracking catalyst can include a large pore molecular sieve that is selective for cracking of branched hydrocarbons and/or cyclic hydrocarbons. Zeolite Y, such as ultrastable zeolite Y (USN) is an example of a zeolite molecular sieve that is selective for cracking of branched hydrocarbons and cyclic hydrocarbons. Depending on the aspect, the silica to alumina ratio in a USY zeolite can be at least about 10, such as at least about 15, or at least about 25, or at least about 50, or at least about 100. Depending on the aspect, the unit cell size for a USY zeolite can be about 24.50 Angstroms or less, such as about 24.45 Angstroms or less, or about 24.40 Angstroms or less, or about 24.35 Angstroms or less, such as about 24.30 Angstroms.

In various embodiments, the conditions selected for hydrocracking can depend on the desired level of conversion, the level of contaminants in the input feed to the hydrocracking stage, and potentially other factors. A hydrocracking process performed under sour conditions, such as conditions where the sulfur content of the input feed to the hydrocracking stage is at least 500 wppm, can be carried out at temperatures of about 550° F. (288° C.) to about 840° F. (449° C.), hydrogen partial pressures of from about 250 psig to about 5000 psig (1.8 MPag to 34.6 MPag), liquid hourly space velocities of from 0.05 $h^{-1}$ to 10 $h^{-1}$, and hydrogen treat gas rates of from 35.6 in/$m^3$ to 1781 $m^3/m^3$ (200 SCF/B to 10,000 SCF/B). In other embodiments, the conditions can include temperatures in the range of about 600° F. (343° C.) to about 815° F. (435° C.), hydrogen partial pressures of from about 500 psig to about 3000 psig (3.5 MPag-20.9 MPag), liquid hourly space velocities of from about 0.2 $h^{-1}$ to about 2 h and hydrogen treat gas rates of from about 213 $m^3/m^3$ to about 1068 $m^3/m^3$ (1200 SCF/B to 6000 SCF/B).

A hydrocracking process performed under non-sour conditions can be performed under conditions similar to those used for sour conditions, or the conditions can be different. Alternatively, a non-sour hydrocracking stage can have less severe conditions than a similar hydrocracking stage operating under sour conditions. Suitable hydrocracking conditions can include temperatures of about 550° F. (288° C.) to about 840° F. (449° C.), hydrogen partial pressures of from about 250 psig to about 5000 psig (1.8 MPag to 34.6 MPag), liquid hourly space velocities of from 0.05 $h^{-1}$ to 10 $h^{-1}$, and hydrogen treat gas rates of from 35.6 $m^3/m^3$ to 1781 $m^3/m^3$ (200 SCF/B to 10,000 SCF/B). In other embodiments, the conditions can include temperatures in the range of about 600° F. (343° C.) to about 815° F. (435° C.), hydrogen partial pressures of from about 500 psig to about 3000 psig (3.5 MPag-20.9 MPag), liquid hourly space velocities of from about 0.2 $h^{-1}$ to about 2 $h^{-1}$ and hydrogen treat gas rates of from about 213 $m^3/m^3$ to about 1068 $m^3/m^3$ (1200 SCF/B to 6000 SCF/B).

Dewaxing Process

In various embodiments, a dewaxing catalyst is also included. Typically, the dewaxing catalyst is located in a bed downstream from any hydrocracking catalyst stages and/or any hydrocracking catalyst present in a stage. This can allow the dewaxing to occur on molecules that have already been hydrotreated or hydrocracked to remove a significant fraction of organic sulfur- and nitrogen-containing species. The dewaxing catalyst can be located in the same reactor as at least a portion of the hydrocracking catalyst in a stage. Alternatively, the effluent from a reactor containing hydrocracking catalyst, possibly after a gas-liquid separation, can be fed into a separate stage or reactor containing the dewaxing catalyst.

Suitable dewaxing catalysts can include molecular sieves such as crystalline aluminosilicates (zeolites). In an embodiment, the molecular sieve can comprise, consist essentially of, or be ZSM-5, ZSM-22, ZSM-23, ZSM-35, ZSM-48, zeolite Beta, ZSM-57, or a combination thereof, for example ZSM-23 and/or ZSM-48, or ZSM-48 and/or zeolite Beta. Optionally but preferably, molecular sieves that are selective for dewaxing by isomerization as opposed to cracking can be used, such as ZSM-48, zeolite Beta, ZSM-23, or a combination thereof. Additionally or alternately, the molecular sieve can comprise, consist essentially of or be a 10-member ring 1-D molecular sieve. Examples include EU-1, ZSM-35 (or ferrierite), ZSM-11, ZSM-57, NU-87, SAPO-11, ZSM-48, ZSM-23, and ZSM-22. Preferred materials are EU-2, EU-11, ZBM-30, ZSM-48, or ZSM-23. ZSM-48 is most preferred. Note that a zeolite having the ZSM-23 structure with a silica to alumina ratio of from about 20:1 to about 40:1 can sometimes be referred to as SSZ-32. Other molecular sieves that are isostructural with the above materials include Theta-1, NU-10, EU-13, KZ-1, and NU-23. Optionally but preferably, the dewaxing catalyst can include a binder for the molecular sieve, such as alumina, titania, silica, silica-alumina, zirconia, or a combination thereof, for example alumina and/or titania or silica and/or zirconia and/or titania.

Preferably, the dewaxing catalysts used in processes according to the invention are catalysts with a low ratio of silica to alumina. For example, for ZSM-48, the ratio of silica to alumina in the zeolite can be less than 200:1, or less than 110:1, or less than 100:1, or less than 90:1, or less than 80:1. In various embodiments, the ratio of silica to alumina can be from 30:1 to 200:1, 60:1 to 110:1, or 70:1 to 100:1.

In various embodiments, the catalysts according to the invention further include a metal hydrogenation component. The metal hydrogenation component is typically a Group VI and/or a Group VIII metal. Preferably, the metal hydrogenation component is a Group VIII noble metal. Preferably, the metal hydrogenation component is Pt, Pd, or a mixture thereof. In an alternative preferred embodiment, the metal hydrogenation component can be a combination of a non-noble Group VIII metal with a Group VI metal. Suitable combinations can include Ni, Co, or Fe with Mo or W, preferably Ni with Mo or W.

The metal hydrogenation component may be added to the catalyst in any convenient manner. One technique for adding the metal hydrogenation component is by incipient wetness. For example, after combining a zeolite and a binder, the combined zeolite and binder can be extruded into catalyst particles. These catalyst particles can then be exposed to a solution containing a suitable metal precursor. Alternatively, metal can be added to the catalyst by ion exchange, where a metal precursor is added to a mixture of zeolite (or zeolite and binder) prior to extrusion.

The amount of metal in the catalyst can be at least 0.1 wt % based on catalyst, or at least 0.15 wt %, or at least 0.2 wt %, or at least 0.25 wt %, or at least 0.3 wt %, or at least 0.5 wt % based on catalyst. The amount of metal in the catalyst can be 20 wt % or less based on catalyst, or 10 wt % or less, or 5 wt % or less, or 2.5 wt % or less, or 1 wt % or less. For embodiments where the metal is Pt, Pd, another Group VIII noble metal, or a combination thereof, the amount of metal can be from 0.1 to 5 wt %, preferably from 0.1 to 2 wt %, or 0.2.5 to 1.8 wt %, or 0.4 to 1.5 wt %. For embodiments where the metal is a combination of a non-noble Group VIII metal with a Group VI metal, the combined amount of metal can be from 0.5 wt % to 20 wt %, or 1 wt % to 15 wt %, or 2.5 wt % to 10 wt %.

The dewaxing catalysts useful in processes according to the invention can also include a binder. In some embodiments, the dewaxing catalysts used in process according to the invention are formulated using a low surface area binder, a low surface area binder represents a binder with a surface area of 100 $m^2/g$ or less, or 80 $m^2/g$ or less, or 70 $m^2/g$ or less.

A zeolite can be combined with binder in any convenient manner. For example, a bound catalyst can be produced by starting with powders of both the zeolite and binder, combining and mulling the powders with added water to form a mixture, and then extruding the mixture to produce a bound catalyst of a desired size. Extrusion aids can also be used to modify the extrusion flow properties of the zeolite and binder mixture. The amount of framework alumina in the catalyst may range from 0.1 to 3.33 wt %, or 0.1 to 2.7 wt %, or 0.2 to 2 wt %, or 0.3 to 1 wt %.

In yet another embodiment, a binder composed of two or more metal oxides can also be used. In such an embodiment, the weight percentage of the low surface area binder is preferably greater than the weight percentage of the higher surface area binder. Alternatively, if both metal oxides used for forming a mixed metal oxide binder have a sufficiently low surface area, the proportions of each metal oxide in the binder are less important. When two or more metal oxides are used to form a binder, the two metal oxides can be incorporated into the catalyst by any convenient method. For example, one binder can be mixed with the zeolite during formation of the zeolite powder, such as during spray drying. The spray dried zeolite/binder powder can then be mixed with the second metal oxide binder prior to extrusion. In yet another embodiment, the dewaxing catalyst is self-bound and does not contain a binder.

A bound dewaxing catalyst can also be characterized by comparing the micropore (or zeolite) surface area of the catalyst with the total surface area of the catalyst. These surface areas can be calculated based on analysis of nitrogen porosimetry data using the BET method for surface area measurement. Previous work has shown that the amount of zeolite content versus binder content in catalyst can be determined from BET measurements (see, e.g., Johnson, M. F. L., *Jour. Catal.,* (1978) 52, 425). The micropore surface area of a catalyst refers to the amount of catalyst surface area provided due to the molecular sieve and/or the pores in the catalyst in the BET measurements. The total surface area represents the micropore surface plus the external surface area of the bound catalyst. In one embodiment, the percentage of micropore surface area relative to the total surface area of a bound catalyst can be at least about 35%, for example at least about 38%, at least about 40%, or at least about 45%. Additionally or alternately, the percentage of micropore surface area relative to total surface area can be about 65% or less, for example about 60% or less, about 55% or less, or about 50% or less.

Additionally or alternately, the dewaxing catalyst can comprise, consist essentially of, or be a catalyst that has not been dealuminated. Further additionally or alternately, the binder for the catalyst can include a mixture of binder materials containing alumina.

Process conditions in a catalytic dewaxing zone can include a temperature of about 200° C. to about 450° C., preferably about 270° C. to about 400° C., a hydrogen partial pressure of about 1.8 MPag to about 34.6 MPag (250 psig to 5000 psig), preferably about 4.8 MPag to about 20.8 MPag, and a hydrogen treat gas rate of about 35.6 $m^3/m^3$ (200 SCF/B) to about 1781 $m^3/m^3$ (10,000 scf/B), preferably about 178 $m^3/m^3$ (1000 SCF/B) to about 890.6 $m^3/m^3$ (5000 SCF/B). In still other embodiments, the conditions can include temperatures in the range of about 600° F. (343° C.) to about 815° F. (435° C.), hydrogen partial pressures of from about 500 psig to about 3000 psig (3.5 MPag-20.9 MPag), and hydrogen treat gas rates of from about 213 $m^3/m^3$ to about 1068 $m^3/m^3$ (1200 SCF. The LHSV can be from about 0.1 $h^{-1}$ to about 10 $h^{-1}$, such as from about 0.5 to about 5 $h^{-1}$ and/or from about 1 $h^{-1}$ to about 4 $h^{-1}$.

Hydrofinishing and/or Aromatic Saturation Process

In various embodiments, a hydrofinishing and/or aromatic saturation stage may also be provided. The hydrofinishing and/or aromatic saturation can occur after the last hydrocracking or dewaxing stage. The hydrofinishing and/or aromatic saturation can occur either before or after fractionation, if hydrofinishing and/or aromatic saturation occurs after fractionation, the hydrofinishing can be performed on one or more portions of the fractionated product, such as being performed on one or more lubricant base oil portions. Alternatively, the entire effluent from the last hydrocracking or dewaxing process can be hydrofinished and/or undergo aromatic saturation.

In some situations, a hydrofinishing process and an aromatic saturation process can refer to a single process performed using the same catalyst. Alternatively, one type of catalyst or catalyst system can be provided to perform aromatic saturation, while a second catalyst or catalyst system can be used for hydrofinishing. Typically a hydrofinishing and/or aromatic saturation process will be performed in a separate reactor from dewaxing or hydrocracking processes for practical reasons, such as facilitating use of a lower temperature for the hydrofinishing or aromatic saturation process. However, an additional hydrofinishing reactor following a hydrocracking or dewaxing process but prior to fractionation could still be considered part of a second stage of a reaction system conceptually.

Hydrofinishing and/or aromatic saturation catalysts can include catalysts containing Group VI metals, Group VIII metals, and mixtures thereof. In an embodiment, preferred metals include at least one metal sulfide having a strong hydrogenation function. In another embodiment, the hydrofinishing catalyst can include a Group VIII noble metal, such as Pt, Pd, or a combination thereof. The mixture of metals may also be present as bulk metal catalysts wherein the amount of metal is about 30 wt. % or greater based on catalyst. Suitable metal oxide supports include low acidic oxides such as silica, alumina, silica-aluminas or titania, preferably alumina. The preferred hydrofinishing catalysts for aromatic saturation will comprise at least one metal having relatively strong hydrogenation function on a porous support. Typical support materials include amorphous or crystalline oxide materials such as alumina, silica, and silica-alumina. The support materials may also be modified, such as by halogenation, or in particular fluorination. The metal content of the catalyst is often as high as about 20 weight percent for non-noble metals. In an embodiment, a preferred hydrofinishing catalyst can include a crystalline material belonging to the M41S class or family of catalysts. The M41S family of catalysts are mesoporous materials having high silica content. Examples include MCM-41, MCM-48 and MCM-50. A preferred member of this class is MCM-41. If separate catalysts are used for aromatic saturation and hydrofinishing, an aromatic saturation catalyst can be selected based on activity and/or selectivity for aromatic saturation, while a hydrofinishing catalyst can be selected based on activity for improving product specifications, such as product color and polynuclear aromatic reduction.

Hydrofinishing conditions can include temperatures from about 125° C. to about 425° C., preferably about 180° C. to about 280° C., total pressures from about 500 psig (3.4 MPa) to about 3000 psig (20.7 MPa), preferably about 1500 psig (10.3 MPa) to about 2500 psig (17.2 MPa), and liquid hourly space velocity from about 0.1 $hr^{-1}$ to about 5 $hr^{-1}$ LHSV; preferably about 0.5 $hr^{-1}$ to about 1.5 $hr^{-1}$.

Example 1

Separation Between Hydrotreatment and Hydrocracking

In this example, a vacuum gas oil feedstock was hydroprocessed using a variety of reaction system configurations. In Configuration A, a feedstock was hydrotreated and hydrocracked, with the effluent from hydrotreatment being cascaded into the hydrocracking stage. This corresponds roughly to the configuration shown in FIG. 1. In Configuration B, the hydrotreated effluent was stripped of gases prior to entering the hydrocracking stage. In Configuration C, the hydrotreated effluent was both stripped fractionated, so that only the portion of the effluent having a higher boiling range than a distillate product was passed into the hydrocracking stage. Configurations B and C correspond to variations of the configuration shown in FIG. 2.

In this Example, the vacuum gas oil feedstock shown in Table 1 was exposed to the hydrotreatment and hydrocracking stages. In addition to the sulfur content, nitrogen content, and API gravity, Table 1 also provides details about the boiling point profile of the feed. The T5 temperature corresponds to the temperature at which 5 wt % of the feed can be distilled (can be determined, for example, according to D2887), while the T95 temperature corresponds to a similar 95 wt % boiling point for the feed. The row for percentage of the feed with a boiling point between 350° F. (177° C.) and 700° F. (371° C.) corresponds to the percentage of the feed that boils in the distillate product range according to the definitions in this description.

TABLE 1

| Feedstock | |
|---|---|
| Feed Property | Feed 1 |
| S | 2.6 wt % |
| N | 828 ppm |
| API/SO | 22.1 |
| T5 | 661° F. (349° C.) |
| T95 | 950° F. (510° C.) |
| %350-700° F. | 11 wt % |

In this Example, the feedstock is exposed to a hydrotreating stage (R1) followed by a hydrocracking stage (R2). Table 2 shows the results from processing of the feedstock in Table 1 over various catalysts in a reaction system corresponding to Configuration A. The pressures and temperatures shown in Table 2 were used in both stages of the reaction system. The hydrotreating catalyst corresponds to a commercially available NiMo supported hydrotreating catalyst. It is designated in the table as "HDT". Various catalysts were used as a hydrocracking catalyst, as shown in columns 3-6 of Table 2. For the hydrocracking catalysts shown in columns 3-6, each catalyst included the molecular sieve indicated in the table and comparable amounts of NiW supported on the catalyst. For the USY hydrocracking catalyst in column 6, the USY had a silica to alumina ratio of about 10 and a unit cell size of about 24.50 Angstroms. Note that column 2 in Table 2 represents a comparative example where the hydrotreating catalyst was used in both of the reactor stages. In other words, the process configuration for column 2 corresponds to two stages of hydrotreating.

TABLE 2

Configuration A Hydroprocessing Results (no intermediate separation)

| | 1—Feed 1 | 2—HDT only | 3 | 4 | 5 | 6 |
|---|---|---|---|---|---|---|
| P, sig | | 1875 | 1875 | 1875 | 1875 | 1875 |
| T, F | | 710 | 710 | 710 | 710 | 710 |
| LHSV | | 1 | 1 | 1 | 1 | 1 |
| R1 catalyst | | HDT | HDT | HDT | HDT | MT |
| R2 catalyst | | HDT | ZSM48 | ZSM-5 | Beta | USY |
| Conv % | | 30 | 40 | 45 | 50 | 60 |
| % distillate (350° F.-700° F.) | 11 | 29 | 33 | 30 | 32 | 35 |

As shown in Table 2, using a hydrocracking catalyst in the second stage of Configuration A results in additional conversion, but only a modest amount of additional production of distillate boiling range product. The largest amount of distillate boiling range product was generated when using the USY hydrocracking catalyst.

Table 3 shows examples of the benefits of using either Configuration B or Configuration C in order to improve distillate yield. Configurations B and C are similar to Configuration A, with the exception of stripping of gases (Configuration B) or fractionation to generate an intermediate distillate product (Configuration C). In Configuration C, only the portion of the effluent boiling above the distillate product (>700° F. or 371° C.) is passed into the hydrocracking stage R2. The same type of USY catalyst is used for each of the runs shown in Table 3.

TABLE 3

Benefit of Intermediate Stripping or Fractionation

| | Direct cascade (Case 6 from Table 2) | R1-< stripping of gases>-R2 Configuration B | R1-<fractionation>-R2 Configuration C |
|---|---|---|---|
| P | 1875 | 1875 | 1875 |
| T | 710 | 710 | 710 |
| LHSV | 1 | 1 | 1 |
| R1 catalyst | HDT | HDT | HDT |
| R2 catalyst | USY | USY | USY |
| Conv | 60 | 60 | 60 |
| % distillate | 35 | 36 | 45 |

As shown in Table 3, stripping out contaminant gases between the hydrotreatment and hydrocracking stages (Configuration B) provided only slightly higher distillate yield at the same level of conversion. By contrast, fractionating the effluent from hydrotreatment (Configuration C) so that only the 700° F.+ portion is passed into the hydrocracking stage generated 10 wt % of additional distillate product relative to Configuration A.

Example 2

Stripping or Fractionation During Hydrotreatment

In this example, vacuum gas oil feedstocks were hydrotreated using various configurations to achieve a desired level of sulfur removal. The hydrotreated effluents generated from these configurations could, for example, be used as input feeds for a subsequent hydrocracking stage according to other configurations described herein. In Configuration D, a feed was hydrotreated to achieve a desired amount of sulfur removal without any intermediate separation. This can correspond, for example, to a single stage of hydrotreatment (such as a single hydrotreatment reactor), or using two stages or reactors with a cascade of effluent from the first reactor to the second reactor. In Configuration E, the effluent from a first hydrotreating stage (Stage 1) was stripped to remove contaminant gases prior to passing the effluent into a second hydrotreating stage (Stage 2). In Configuration F, the effluent from a first hydrotreating stage was both stripped and fractionated, so that only the portion of the effluent having a higher boiling range than a distillate product is passed into the second hydrotreating stage. Configurations B and C correspond to variations of the configuration shown in FIG. 3.

Table 4 shows various feedstocks used in this Example. In addition to the sulfur content, nitrogen content, and API gravity, Table 1 also provides details about the boiling point profile of the feed. The T5 temperature corresponds to the temperature at which 5 wt % of the feed can be distilled (can be determined, for example, according to D2887), while the T95 temperature corresponds to a similar 95 wt % boiling point for the feed. The row for percentage of the feed with a boiling point between 350° F. (177° C.) and 700° F. (371° C.) corresponds to the percentage of the feed that boils in the distillate product range according to the definitions in this description. It is noted that Feed 1 is the same as Feed 1 in Example 1.

TABLE 4

Feed Properties for Vacuum Gas Oils

| Feed Properties | Feed 1 | Feed 2 |
|---|---|---|
| S (wt %) | 2.6% | 2.66 |
| N | 828 ppm | 917 ppm |
| API | 22.1 | 0.8985 |
| T5 | 661 F. | 334 C. |
| T95 | 950 F. | 597 C. |
| %350° F.-700° F. (wt %) | 11% | 5% |

Table 5 shows the amount of distillate product generated by processing Feed 1 from Table 4 in Configuration D at different levels of severity over two different catalysts. One catalyst is the supported NiMo hydrotreating catalyst described in Example 1. The second catalyst corresponds to a commercially available bulk NiMo catalyst. In Table 5, the supported catalyst is designated by "HDT", while the bulk hydrotreating catalyst is designated by "Bulk Cat".

TABLE 5

Processing of Feed 1 in Configuration D

| | <Feed 1> | HDT | HDT | Bulk Cat | Bulk Cat |
|---|---|---|---|---|---|
| P | | 1875 psig | 1875 psig | 1275 psig | 1275 psig |
| T | | 680 F. | 710 F. | 680 F. | 710 F. |
| LHSV ($hr^{-1}$) | | 1 | 1 | 1 | 1.14 |
| N | 828 ppm | 25 ppm | 10 ppm | 10 ppm | 10 ppm |
| S | 2.6 wt % | 600 ppm | 49 ppm | 100 ppm | 23 ppm |
| %350° F. 700° F. (wt %) | 11 | 21 | 35 | 25 | 36 |

As shown in Table 5, increasing the severity of the hydrotreating conditions resulted in increased distillate product yields. This is in addition to the expected decrease in the amount of sulfur remaining in the hydrotreated feed.

Table 6 shows results from processing of Feed 2 in Configuration D and Configuration E. For processing in Configuration E, the supported NiMo catalyst MDT) is used in both R1 and R2. Under similar reaction conditions, Configuration E resulted in removal of sulfur and nitrogen that is at least comparable to Configuration D, with an additional 9 wt % of distillate product yield.

TABLE 6

Improved Distillate Yield with Intermediate Stripping (Configuration E)

| | Feed 2 | HDT | R1 HDT-<stripping of gases>-R2 HDT |
|---|---|---|---|
| P | | 1875 | 1875 |
| T | | 710 F. | 710 |
| LHSV | | 1 | 1 |
| N | 917 ppm | 10 | <10 |
| S | 2.66% | 21 | <21 |
| %350-700 F. | 5 | 28 | 37 |

Table 7 shows results from processing of Feed 2 in Configuration D and Configuration F. For processing in Configuration F, the supported NiMo catalyst (HDT) is used in both R1 and R2. Under similar reaction conditions, Configuration F resulted in removal of sulfur and nitrogen that is at least comparable to Configuration D, with an additional 20 wt % of distillate product yield.

TABLE 7

Improved Distillate Yield with Int. Fractionation (Configuration F)

| | Feed 2 | HDT only | R1 HDT-<fractionation>-R2 HDT |
|---|---|---|---|
| P | | 1875 | 1875 |
| T | | 710 F. | 710 |
| LHSV | | 1 | 1 |
| N | 917 ppm | 10 | <10 |
| S | 2.66% | 21 | <21 |
| %350-700 F. | 5 | 28 | 48 |

Example 3

Isomerization Dewaxing Prior to Hydrocracking

This example demonstrates the benefits of stacking medium pore dewaxing catalysts with isomerization activity in the proper order relative to large pore hydrocracking catalysts. In this example, a vacuum gas oil feedstock was hydrotreated, fractionated to separate out any distillate boiling range product generated during hydrotreatment, and then hydrocracked. In most of the process runs described in this example, the hydrotreated effluent was also dewaxed prior to hydrocracking. The configuration is generally similar to the configuration shown in FIG. 2, with the dewaxing and hydrocracking catalyst both being located in the R2 reactor. The feed used in this example corresponds to Feed 1 from Table 4 above.

The hydrotreatment in this example was performed using the commercially available supported NiMo hydrotreating catalyst that is referenced in the other examples as the "HDT" catalyst. The hydrocracking catalyst used in this example is a USY catalyst with a silica to alumina ratio of about 10 and a unit cell size of about 24.50 Angstroms. The dewaxing catalysts are specified in Tables 8 and 9 below, along with the process conditions for both the hydrotreatment and the dewaxing/hydrocracking stages. The dewaxing catalysts further include 0.6 wt % of Pt supported on the catalyst as a hydrogenation metal. The medium pore dewaxing catalysts shown in Table 8 include ZSM-48, ZSM-5, ZSM-22, zeolite Beta, ZSM-23, ZSM-35, and ZSM-57. In this example, the R2 reactor was loaded with approximately 30 wt % of dewaxing catalyst and 70 wt % of hydrocracking catalyst.

Table 8 shows results from a series of process runs with different medium pore dewaxing catalysts located upstream from the USY hydrocracking catalyst. For comparison, the first process run in Table 8 shows the result of processing the feedstock without a dewaxing catalyst prior to the hydrocracking catalyst.

TABLE 8

Dewaxing Prior to Hydrocracking

| | 1 | 2 | 3 | 4 | 5 | 6 | 7 | 8 |
|---|---|---|---|---|---|---|---|---|
| P, psig | 1275 | 1275 | 1275 | 1275 | 1275 | 1275 | 1275 | 1275 |
| T, F | 700 | 700 | 700 | 700 | 700 | 700 | 700 | 700 |
| LHSV | 2 | 2 | 2 | 2 | 2 | 2 | 2 | 2 |
| R1 catalyst | HDT | HDT | HDT | HDT | HDT | HDT | HDT | KF-848 |
| R2 catalyst1 | None | ZSM-48 | ZSM-5 | ZSM-72 | Beta | ZSM-23 | ZSM-35 | ZSM-57 |
| R2 catalyst2 | USY | USY | USY | USY | USY | USY | USY | USY |
| Conv | 40 | 50 | 60 | 55 | 75 | 44 | 44 | 48 |
| % distillate (350° F.-700° F.) | 35 | 39 | 31 | 33 | 35 | 35 | 32 | 31 |

As shown in Table 8, exposing the hydrotreated effluent to ZSM-48 prior to hydrocracking unexpectedly results in an increase in both feed conversion and distillate product yield (350° F. 700° F., 177° C. 371° C.). The remaining dewaxing catalysts are effective for improving the conversion at constant severity, but the distillate yield is similar or lower relative to exposing the feed to the hydrocracking catalyst without prior dewaxing.

To further demonstrate the benefits of exposing a hydrotreated feed to the dewaxing catalyst prior to hydrocracking, Table 9 shows the results from several variations for stacking the dewaxing catalyst with the hydrocracking catalyst. In Table 9, columns 1 and 2 are the same as columns 1 and 2 in Table 8. Column 3 provides a comparison with dewaxing the effluent from hydrocracking Column 4 provides a comparison with having the dewaxing and hydrocracking catalysts mixed within the catalyst bed, so that the hydrotreated effluent is exposed to both catalysts at the same time instead of sequentially. As shown in Table 9, exposing the hydrotreated feed to the dewaxing catalyst prior to the hydrocracking catalyst in sequence (run 2 in Table 9) provides superior conversion and distillate yield relative to using a mixed bed of dewaxing and hydrocracking catalyst (run 9). The results are also superior to having the dewaxing catalyst located after the hydrocracking catalyst (run 10).

TABLE 9

Alternatives for Stacking of Dewaxing and Hydrocracking Catalyst

| | 1 | 2 | 9 | 10 |
|---|---|---|---|---|
| P | 1275 | 1275 | 1275 | 1275 |
| T | 700 | 700 | 700 | 700 |
| LHSV | 2 | 7 | 2 | 2 |
| R1 catalyst | HDT | HDT | HDT | HDT |
| R2 catalyst1 | None | ZSM-48 | USY | ZSM48 + USY |
| R2 catalyst2 | USY | USY | ZSM-48 | none |
| Conv | 40 | 50 | 35 | 39 |
| % distillate | 35 | 39 | 31 | 35 |

Additional Embodiments

Embodiment 1

A method for processing a feedstock to form a distillate product, comprising: contacting a feedstock having a T5 boiling point of at least about 473° F. (245° C.) with a first hydrotreating catalyst under first effective hydrotreating conditions to produce a first hydrotreated effluent, the first hydrotreating catalyst comprising at least one Group VIII non-noble metal and at least one Group VIB metal on a refractory support; performing a separation on the first hydrotreated effluent to form at least a first separated effluent portion and a first remaining effluent portion; contacting the first remaining effluent portion with a second hydrotreating catalyst under second effective hydrotreating conditions to produce a second hydrotreated effluent, the second hydrotreating catalyst comprising at least one Group VIII non-noble metal and at least one Group VIB metal on a refractory support; fractionating the second hydrotreated effluent to form at least a hydrotreated distillate boiling range product and a second remaining effluent portion, the second remaining effluent portion having a T5 boiling point of at least about 700° F. (371° C.); contacting the second remaining effluent portion with a hydrocracking catalyst under effective hydrocracking conditions to produce a hydrocracked effluent, the hydrocracking catalyst comprising a large pore molecular sieve; and fractionating the hydrocracked effluent to produce at least a hydrocracked distillate boiling range product.

Embodiment 2

The method of Embodiment 1, wherein performing a separation on the first hydrotreated effluent comprises stripping the first hydrotreated effluent.

Embodiment 3

The method of any of the above Embodiments, wherein the first separated effluent portion has a T95 boiling point of about 300° F. (149° C.) or less.

Embodiment 4

The method of any of the above Embodiments, wherein performing a separation on the first hydrotreated effluent comprises fractionating the first hydrotreated effluent, the first separated effluent comprising at least an intermediate distillate boiling range product.

Embodiment 5

The method of Embodiment 4, wherein the first remaining effluent has a T5 boiling point of at least about 600° F. (316° C.), such as at least about 700° F. (371° C.).

Embodiment 6

The method of any of the above Embodiments, wherein the first hydrotreating catalyst is the same as the second hydrotreating catalyst, and the first effective hydrotreating conditions are the same as the second effective hydrotreating conditions.

Embodiment 7

The method of any of the above Embodiments, wherein the first hydrotreating catalyst and/or the second hydrotreating catalyst comprises an amorphous support, a support that is substantially free of molecular sieve, or a combination thereof.

Embodiment 8

The method of any of the above Embodiments, wherein the feedstock has a T5 boiling point of at least about 600° F. (316° C.), such as at least about 650° F. (343° C.).

Embodiment 9

The method of any of the above Embodiments, further comprising contacting the second remaining effluent portion with a medium pore dewaxing catalyst under effective dewaxing conditions prior to contacting the second remaining effluent portion with the large pore hydrocracking catalyst, the medium pore dewaxing catalyst optionally comprising a 10-member ring 1-dimensional dewaxing catalyst.

Embodiment 10

The method of Embodiment 9, wherein the medium pore dewaxing catalyst comprises, EU-1, ZSM-35 (©r ferrierite), ZSM-11, ZSM-57, SAPO-11, ZSM-48, ZSM-23, and ZSM-22, or a combination thereof the dewaxing catalyst preferably comprising LSM-48, ZSM-57, ZSM-23, or a combination thereof, and more preferably comprising ZSM-48.

Embodiment 11

The method of Embodiments 9 or 10, wherein the effective dewaxing conditions comprise a temperature of about 200° C. to about 450° C., a hydrogen partial pressure of about 1.8 MPag to about 34.6 MPag (250 psig to 5000 psig), a hydrogen treat gas rate of about 35.6 $m^3/m^3$ (200 SCF/B) to about 1781 m (10,000 scf/B), and an LHSV of about 0.1 $h^{-1}$ to about 10 $h^{-1}$.

Embodiment 12

The method of any of the above Embodiments, wherein the first effective hydrotreating conditions comprise a temperature of about 200° C. to about 450° C., a pressure of about 250 psig (1.8 MPag) to about 5000 psig (34.6 MPag), a liquid hourly space velocities (LHSV) of about 0.1 $hr^{-1}$ to about 10

$hr^{-1}$, and a hydrogen treat gas rate of about 200 scf/B (35.6 $m^3/m^3$) to about 10,000 scf/B (1781 $m^3/m^3$).

Embodiment 13

The method of any of the above Embodiments, wherein the second effective hydrotreating conditions comprise a temperature of about 200° C. to about 450° C., a pressure of about 250 psig (1.8 MPag) to about 5000 psig (34.6 MPag), a liquid hourly space velocities (LHSV) of about 0.1 $hr^{-1}$ to about 10 $hr^{-1}$, and a hydrogen treat gas rate of about 200 scf/B (35.6 $m^3/m^3$) to about 10,000 scf/B (1781 $m^3/m^3$).

Embodiment 14

The method of any of the above Embodiments, wherein the effective hydrocracking conditions comprise a temperature of about 550° F. (288° C.) to about 840° F. (449° C.), a hydrogen partial pressure of from about 250 psig to about 5000 psig (1.8 MPag to 34.6 MPag), a liquid hourly space velocity of from 0.05 $h^{-1}$ to 10 and a hydrogen treat gas rate of from 35.6 $m^3/M^4$ to 1781 $m^3/m^3$ (200 SCF/B to 10,000 SCF/B), the hydrocracking catalyst preferably comprising USY with a unit cell size of about 24.50 Angstroms or less and a silica to alumina ratio of about 10 to about 200.

Embodiment 15

The method of any of the above Embodiments, further comprising hydrofinishing at least one of the hydrocracked distillate boiling range product or the hydrocracked effluent under effective hydrofinishing conditions, the effective hydrofinishing conditions comprising a temperature from about 180° C. to about 280° C., a total pressures from about 500 psig (3.4 MPa) to about 3000 psig (20.7 MPa), and a liquid hourly space velocity from about 0.1 $hr^{-1}$ to about 5 $hr^{-1}$ LHSV.

When numerical lower limits and numerical upper limits are listed herein, ranges from any lower limit to any upper limit are contemplated. While the illustrative embodiments of the invention have been described with particularity, it will be understood that various other modifications will be apparent to and can be readily made by those skilled in the art without departing from the spirit and scope of the invention. Accordingly, it is not intended that the scope of the claims appended hereto be limited to the examples and descriptions set forth herein but rather that the claims be construed as encompassing all the features of patentable novelty which reside in the present invention, including all features which would be treated as equivalents thereof by those skilled in the art to which the invention pertains.

The present invention has been described above with reference to numerous embodiments and specific examples. Many variations will suggest themselves to those skilled in this art in light of the above detailed description. All such obvious variations are within the full intended scope of the appended claims.

What is claimed is:

1. A method for processing a feedstock to form a distillate product, comprising:

contacting a feedstock having a T5 boiling point of at least about 473° F. (245° C.) with a first hydrotreating catalyst under first effective hydrotreating conditions to produce a first hydrotreated effluent, the first hydrotreating catalyst comprising at least one Group VIII non-noble metal and at least one Group VIB metal on a refractory support;

performing a separation on the first hydrotreated effluent to form at east a first separated effluent portion and a first remaining effluent portion;

contacting the first remaining effluent portion with a second hydrotreating catalyst under second effective hydrotreating conditions to produce a second hydrotreated effluent, the second hydrotreating catalyst comprising at least one Group VIII non-noble metal and at least one Group VIB metal on a refractory support;

fractionating the second hydrotreated effluent to form at least a hydrotreated distillate boiling range product and a second remaining effluent portion, the second remaining effluent portion having a T5 boiling point of at least about 700° F. (371° C.);

contacting the second remaining effluent portion with a hydrocracking catalyst under effective hydrocracking conditions to produce a hydrocracked effluent, the hydrocracking catalyst comprising a large pore molecular sieve; and fractionating the hydrocracked effluent to produce at least a hydrocracked distillate boiling range product.

2. The method of claim 1, wherein performing a separation on the first hydrotreated effluent comprises stripping the first hydrotreated effluent.

3. The method of claim 1, wherein the first separated effluent portion has a T95 boiling point of about 300° F. (149° C.) or less.

4. The method of claim 1, wherein performing a separation on the first hydrotreated effluent comprises fractionating the first hydrotreated effluent, the first separated effluent comprising at least an intermediate distillate boiling range product.

5. The method of claim 4, wherein the first remaining effluent has a T5 boiling point of at least about 700° F. (371° C.).

6. The method of claim 1, wherein the first hydrotreating catalyst is the same as the second hydrotreating catalyst, and the first effective hydrotreating conditions are the same as the second effective hydrotreating conditions.

7. The method of claim 1, wherein the first hydrotreating catalyst comprises an amorphous support, a support that is substantially free of molecular sieve, or a combination thereof.

8. The method of claim 1, wherein the second hydrotreating catalyst comprises an amorphous support, a support that is substantially free of molecular sieve, or a combination thereof.

9. The method of claim 1, wherein the feedstock has a T5 boiling point of at least about 600° F. (316° C.), such as at least about 650° F. (343° C.).

10. The method of claim 1, wherein the feedstock has a T5 boiling point of at least about 650° F. (343° C.).

11. The method of claim 1, further comprising contacting the second remaining effluent portion with a medium pore dewaxing catalyst under effective dewaxing conditions prior to contacting the second remaining effluent portion with the large pore hydrocracking catalyst.

12. The method of claim 11, wherein the medium pore dewaxing catalyst comprises one or more 10-member ring 1-dimensional molecular sieves.

13. The method of claim 11, wherein the medium pore dewaxing catalyst comprises ZSM-48, ZSM-57, ZSM-23, or a combination thereof.

14. The method of claim 11, wherein the effective dewaxing conditions comprise a temperature of about 200° C. to about 450° C., a hydrogen partial pressure of about 1.8 MPag to about 34.6 MPag (250 psig to 5000 psig), a hydrogen treat gas rate of about 35.6 $m^3/m^3$ (200 SCF/B) to about 1781 $m^3/m^3$ (10,000 scf/B), and an LHSV of about 0.1 $h^{-1}$ to about 10 $h^{-1}$.

15. The method of claim 1, wherein the first effective hydrotreating conditions comprise a temperature of about 200° C. to about 450° C., a pressure of about 250 psig 0.8 MPag) to about 5000 psig (34.6 MPag), a liquid hourly space velocities (LHSV) of about 0.1 $hr^{-1}$ to about 10 $hr^{-1}$, and a hydrogen treat gas rate of about 200 scf/B (35.6 $m^3/m^3$) to about 10,000 scf/B (1781 $m^3/m^3$).

16. The method of claim 1, wherein the second effective hydrotreating conditions comprise a temperature of about 200° C. to about 450° C., a pressure of about 250 psig 0.8 MPag) to about 5000 psig (34.6 MPag), a liquid hourly space velocities (LHSV) of about 0.1 $hr^{-1}$ to about 10 $h^{-1}$, and a hydrogen treat gas rate of about 200 scf/B (35.6 $m^3/m$) to about 10,000 scf/B (1781 $m^3/m^3$).

17. The method of claim 1, wherein the effective hydrocracking conditions comprise a temperature of about 550° F. (288° C.) to about 840° F. (449° C.), a hydrogen partial pressure of from about 250 psig to about 5000 psig (1.8 MPag to 34.6 MPag), a liquid hourly space velocity of from 0.05 $h^{-1}$ to 10 $h^{-1}$, and a hydrogen treat gas rate of from 35.6 $m^3/m^3$ to 1781 $m^3/m^3$ (200 SCF/B to 10,000 SCF/B).

18. The method of claim 1, wherein the hydrocracking catalyst comprises USY with a unit cell size of about 24.50 Angstroms or less and a silica to alumina ratio of about 10 to about 200.

19. The method of claim 1, further comprising hydrofinishing at least one of the hydrocracked distillate boiling range product or the hydrocracked effluent under effective hydrofinishing conditions, the effective hydrofinishing conditions comprising a temperature from about 180° C. to about 280° C., a total pressures from about 500 psig (3.4 MPa) to about 3000 psig (20.7 MPa), and a liquid hourly space velocity from about 0.1 $hr^{-1}$ to about 5 $hr^{-1}$ LHSV.

* * * * *